US008641373B2

(12) United States Patent
Porodo et al.

(10) Patent No.: US 8,641,373 B2
(45) Date of Patent: Feb. 4, 2014

(54) DIFFUSER HAVING BLADES WITH APERTURES

(75) Inventors: Jérôme Porodo, Pau (FR); Laurent Tarnowski, Pau (FR); Hubert Vignau, Nay (FR)

(73) Assignee: Turbomeca, Bordes (FR)

( * ) Notice: Subject to any disclaimer, the term of this patent is extended or adjusted under 35 U.S.C. 154(b) by 377 days.

(21) Appl. No.: 13/124,134

(22) PCT Filed: Oct. 15, 2009

(86) PCT No.: PCT/FR2009/051966

§ 371 (c)(1),
(2), (4) Date: Jun. 27, 2011

(87) PCT Pub. No.: WO2010/043820

PCT Pub. Date: Apr. 22, 2010

(65) Prior Publication Data

US 2011/0255962 A1 Oct. 20, 2011

(30) Foreign Application Priority Data

Oct. 17, 2008 (FR) ..... 08 57053

(51) Int. Cl.
*F01D 9/02* (2006.01)

(52) U.S. Cl.
USPC ..... 415/208.3; 415/212.1

(58) Field of Classification Search
USPC ..... 415/208.3, 211, 211.2, 212.1, 115, 116; 416/232
See application file for complete search history.

(56) References Cited

U.S. PATENT DOCUMENTS

| | | | | |
|---|---|---|---|---|
| 3,694,102 | A * | 9/1972 | Conrad | 415/115 |
| 4,022,541 | A * | 5/1977 | Perrigo et al. | 415/207 |
| 4,099,891 | A * | 7/1978 | Campbell | 415/207 |
| 6,210,104 | B1 | 4/2001 | Schonenborn | |
| 7,101,151 | B2 * | 9/2006 | Loringer et al. | 415/211.2 |

FOREIGN PATENT DOCUMENTS

| | | |
|---|---|---|
| GB | 2 041 149 | 9/1980 |
| JP | 54 127014 | 10/1979 |
| JP | 58 59399 | 4/1983 |

OTHER PUBLICATIONS

Nakagawa et al., Diffuser with Vane for Centrifugal Turbomachine, Nov. 1, 1984, Abstract of JP59-192899.*
International Search Report issued Jan. 28, 2010 in PCT/FR09/51966 filed Oct. 15, 2009.

* cited by examiner

*Primary Examiner* — Edward Look
*Assistant Examiner* — Liam McDowell
(74) *Attorney, Agent, or Firm* — Oblon, Spivak, McClelland, Maier & Neustadt, L.L.P.

(57) ABSTRACT

A diffuser for a mixed flow or centrifugal compressor of a gas turbine. The diffuser includes at least one vane presenting a pressure side, a suction side, and a first flank. The vane includes a plurality of orifices opening out into the suction side and/or the pressure side and communicating with at least one cavity formed in the vane, the cavity extending transversely relative to the vane and opening out into its first flank. The cross section of the cavity varies in the transverse direction of the vane, the cross section increasing towards the first flank.

14 Claims, 4 Drawing Sheets

DIFFUSER HAVING BLADES WITH APERTURES

The present invention relates to the compression stages of gas turbines and more particularly to the diffusers that are usually found in such compression stages, e.g. in mixed flow or centrifugal type compressors.

The role of the diffuser is to straighten out the flow coming from the impeller of the compressor so as to recover the dynamic pressure of the fluid in the form of static pressure.

To do this, the diffuser generally comprises a plurality of vanes arranged around a circumference and held between two holder rings.

The deflection imposed by the vanes of the diffuser can give rise to the fluid on the pressure side or on the suction side of the vanes separating, which separation, whenever it is considerable, can lead to detachment of the fluid, and then to surging.

It is known that the surging effect is entirely detrimental to the elements constituting the compressor, so that it is sought to avoid it whenever possible.

The present invention, which seeks to mitigate that drawback, therefore relates more particularly to a diffuser for a mixed flow or centrifugal compressor of a gas turbine, the diffuser comprising at least one vane presenting a pressure side, a suction side, and a first flank, said vane being provided with a plurality of orifices opening out into the suction side and/or to the pressure side and communicating with at least one cavity formed in the vane, said cavity extending transversely relative to the vane and opening out into the first flank. In this example, the transverse direction is the direction extending between the first flank and the second flank of the vane opposite from the first flank.

The idea in this example is to gently suck in the fluid flowing over the suction side and/or on the pressure side so as to prevent it from becoming separated from the vane.

The structure of such a diffuser is already known from document U.S. Pat. No. 6,210,104 that provides an illustration thereof, even though the sought-after aim is different.

That document proposes sucking a portion of the fluid through holes made on the suction side of the vanes in order subsequently to use it as a cooling fluid for cooling hot parts of the turbine.

A drawback of that device is that suction of the fluid carried through the holes is not uniform over the suction side and consequently the fluid may still separate.

An object of the present invention is to propose a diffuser for a centrifugal or mixed flow compressor enabling fluid to be sucked in uniformly.

The invention achieves its object by the fact that the cross section of the cavity varies across the transverse direction of the vane, said cross section increasing towards the first flank.

In other words, the cross section of the cavity at the site of the first flank into which it opens out is greater than the cross section at the bottom of the cavity, it being understood that the bottom of the cavity is transversely opposite from the first flank.

This increase in the cross section of the cavity, considered from the bottom of the cavity, is selected in such a manner that the orifices communicating with said cavity have the same suction rate, and in addition, so that a single orifice has a suction rate that is uniform over its entire section.

Preferably, to do this, the cross-section of the cavity, considered along the transverse direction of the vane, increases proportionally with the increase in the overall suction section. Said overall suction section is equal to the sum of the sections of the orifices if the orifices are holes and/or equal to an integral if the suction orifice, such as a transverse slot, has a suction area that is continuous.

In the invention, the orifices may be located solely in the suction side, solely in the pressure side, or even in both the suction side and the pressure side.

In advantageous manner, the diffuser according to the invention includes a first series of orifices opening out into the suction side and communicating with at least one cavity formed in the vane and opening out into the first flank.

In a first variant, the diffuser includes a single cavity opening out into the first flank. All of the holes in the first series thus communicate with said single cavity formed in a thickness of the vane.

In a second variant, the diffuser includes a plurality of cavities forming recesses opening out into the first flank.

Preferably, said recesses are identical and also preferably, are of frustoconical shape. The cross section of said recesses is therefore a disk of radius that increases towards the first flank.

In advantageous manner, the diffuser further includes a second series of orifices opening out into the pressure side and communicating with at least one other cavity formed in the vane and opening out into one of the two flanks of the vane.

Preferably, said at least one other cavity also opens out into the first flank.

Advantageously, said other cavity has a cross section that varies, increasing towards the first flank.

By means of which, suction of the fluid is as uniform on the suction side of the vane as on its pressure side.

In a variant, the diffuser includes a single cavity opening out into the first flank.

In another variant, the diffuser comprises a plurality of cavities forming recesses opening out into the first flank. In this variant, each cavity is preferably of frustoconical shape.

In addition, the orifices are preferably transverse perforations and/or slots.

In accordance with the invention, several embodiments can be envisaged: perforations and slots may be associated; provision may be made for a plurality of perforations to be in communication with a single recess or even a single slot with a recess, or even for all of the orifices to be in communication with a single cavity formed in the vane.

Preferably but not exclusively, the diffuser is a radial diffuser.

Finally, the invention provides a turboengine including a diffuser in accordance with the present invention.

The invention can be better understood and its advantages appear more clearly on reading the following description of two embodiments given as non-limiting examples. The description makes reference to the accompanying drawings in which.

The diffuser of the present invention is in particular designed to be used with a compressor of the centrifugal or mixed flow type. "Mixed flow compressor" refers to a compressor in which the compressed fluid exits the compressor impeller at an angle lying in the range 0° and 70° relative to a radial direction.

Figure 1:
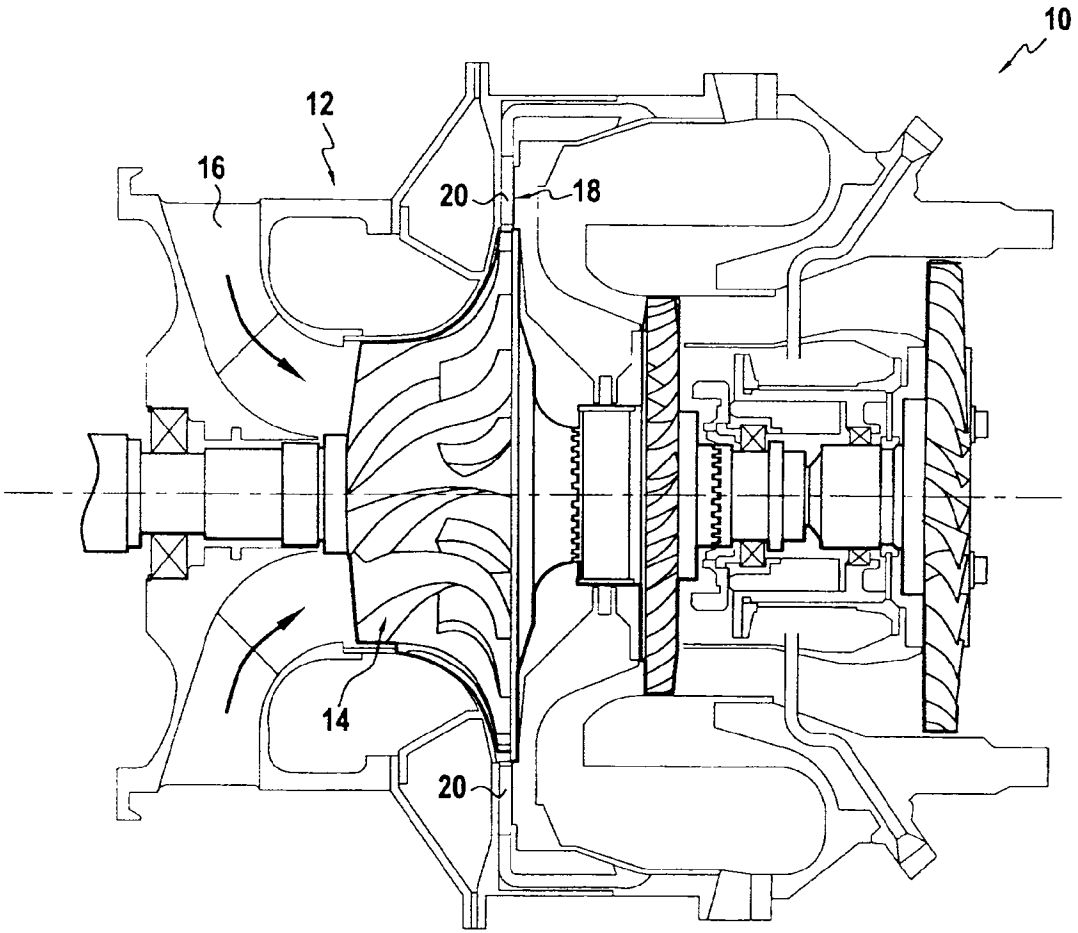
FIG. 1 is a fragmentary section view of a helicopter gas turbine including a centrifugal compressor fitted with a diffuser of the invention.

FIG. 1 shows a gas turbine 10 of a helicopter (not shown) including both a centrifugal compressor 12 that includes a compressor impeller 14 fed from a cool air inlet 16, and a diffuser 18 that is the subject matter of the present invention, which diffuser is arranged downstream from the impeller 14.

In known manner, the compressed air exits the impeller 14 radially while presenting angular momentum. The role of the diffuser 18 is to straighten out the flow F coming from the impeller 14.

To do this, the diffuser 18 comprises a plurality of vanes 20 arranged around the circumference of the diffuser 18. Each vane 20 presents, in known manner, a longitudinal direction L, a transverse direction T, a suction side E, and a pressure side I.

Figure 2:
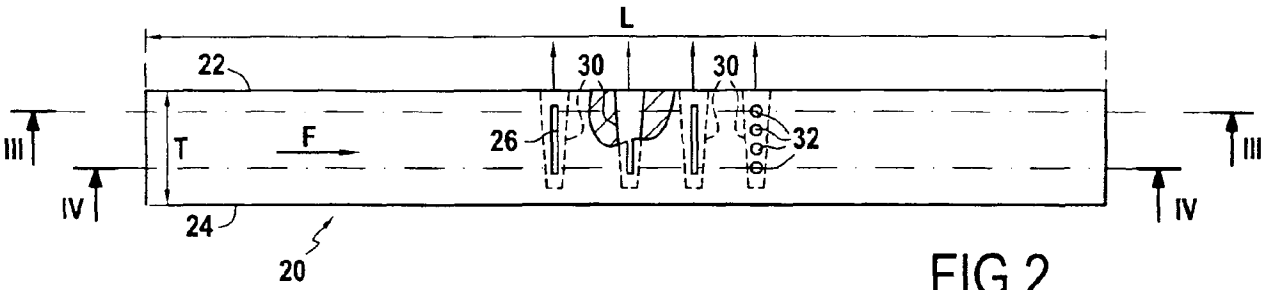
FIG. 2 is a view of a vane of the diffuser in a first embodiment, which vane includes a plurality of slots opening out into its suction side and its pressure side, each of the slots communicating with a recess.
Figure 3:
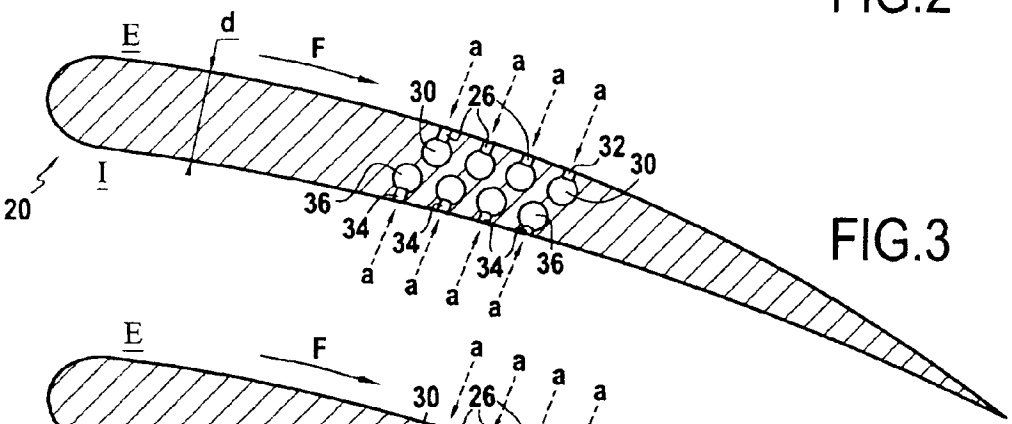
FIG. 3 is a view of the first flank of the vane shown in FIG. 2 on section plane III-III.
Figure 4:
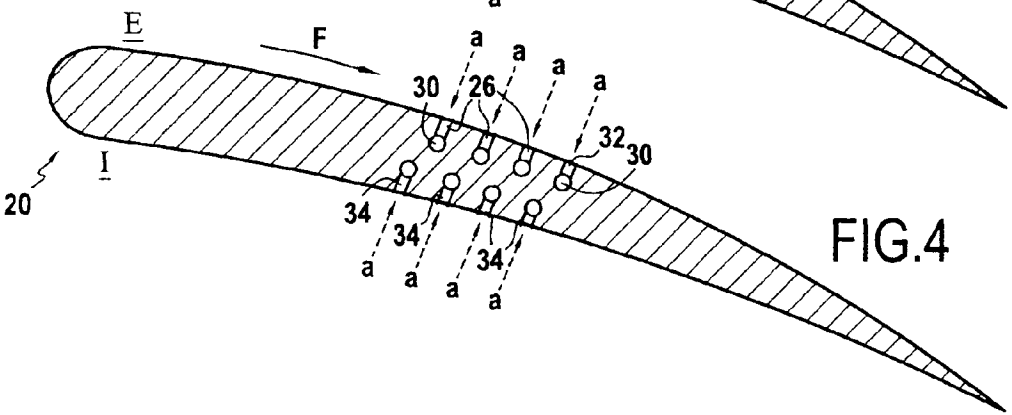
FIG. 4 is a longitudinal section view of the vane shown in FIG. 2 on section plane IV-IV.

With reference to FIGS. 2 to 4, there follows a description of the first embodiment of the diffuser 18 of the present invention.

As can be seen in said figures showing one of the vanes 20, said vane has a first flank 22 and a second flank 24 that is transversely opposite from the first flank 22.

In addition, said vane 20 is provided with a first series of orifices 26 opening out into the suction side E. In this example, the orifices 26 of the first series are constituted by slots extending along the transverse direction T of the vane 20, the slots preferably being identical.

Each slot 26 of the first series is in communication with a cavity 30 forming a recess. The recesses 30, arranged next to one another, are formed in the thickness of the vane 20 in such a manner as to extend transversely relative to said vane while opening out only into the first flank 22 of the vane 20.

As can be seen in FIG. 2, the transverse extent of each recess 30 is slightly greater than the length of the associated slot 26.

Figure 8:
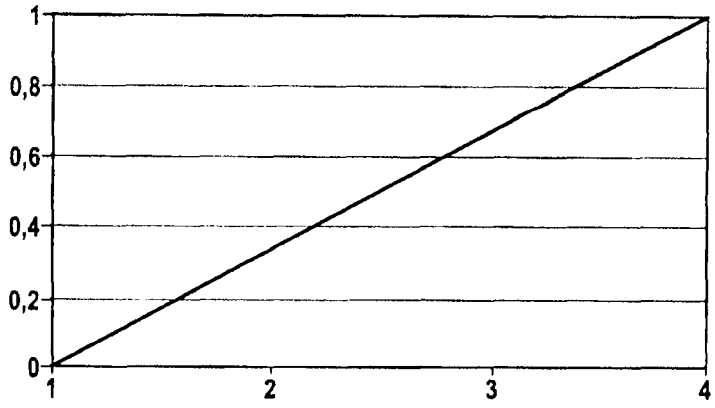
FIG. 8 is a graph showing an example of a relationship for the variation in the cross-section of a cavity.

In accordance with the invention, the cross sections of the recesses 30 vary, increasing towards the first flank, in application of a relationship that varies as shown in FIG. 8. In this event, each recess 30 is of frustoconical shape opening out towards the first flank. It follows that the cross section of each recess, specifically a disk, is greater at the location of the first flank 22 than at the base of the recess 30. In other words, the cross section of the recess increases upon moving transversely from the second flank 24 towards the first flank 22.

This is shown in more clearly in FIGS. 3 and 4: FIG. 3 shows the first flank 22 of the vane 20 into which the recesses 30 open out, while FIG. 4 is a section view taken on a plane extending in the longitudinal direction L of the vane 20 at a distance from the first flank 22. It is observed that the cross section of the recess 30 at the base of the recess 30 is smaller than the cross section at the position of the first flank 22 into which said recess opens out.

The variation in this example therefore follows a linear function. However, provision could be made for the variation to follow other functions that are not linear.

In a variant, the slots 26 may be replaced by perforations 32 arranged side by side and extending transversely as shown in FIG. 2. In this variant, all of the perforations 32 are in communication with the recess 30.

In an advantageous aspect of the present invention, the diffuser 18 further includes a second series of orifices 34, similar to the slots 26, opening out into the pressure side I.

Similarly to the orifices 30 of the first series, the orifices 34 of the second series are in communication with cavities 36, also forming recesses, that are separate from the cavities 30 communicating with the orifices 26 of the first series.

As shown in particular in FIG. 2, the recesses 30 and the recesses 36 are identical and are arranged in two layers.

When fluid is flowing, as represented in the diagram by the arrow F, suction is applied to the recesses 30 and 36, thereby creating a suction action a on the surface of the suction side E and the pressure side I through the first and second series of slots 26, 34.

Said suction a tends to hold the flow of fluid F against the suction side E and the pressure side I of the vane 20, whereby, in advantageous manner, separation of the fluid F tends to be prevented. In other words, the flow of fluid F is forced to take on the shape of the suction side E and of the pressure side I.

Figure 5:
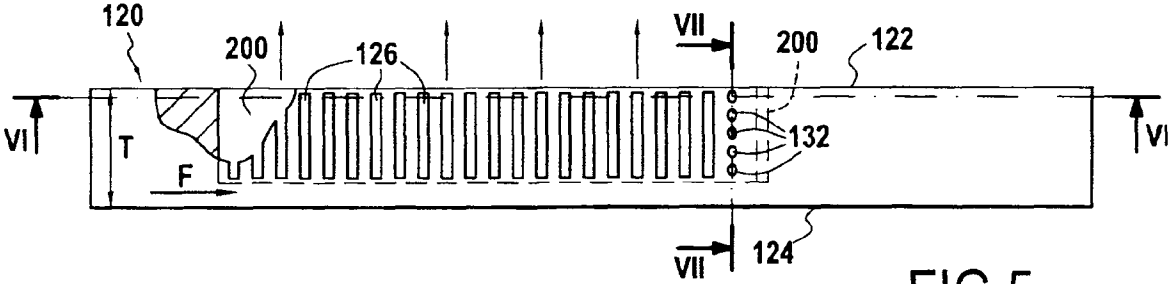
FIG. 5 is a view of a vane of the diffuser in a second embodiment, which vane includes a plurality of slots opening out into its suction side and communicating with a cavity, as well as a plurality of slots opening out into its pressure side and communicating with another cavity.
Figure 6:
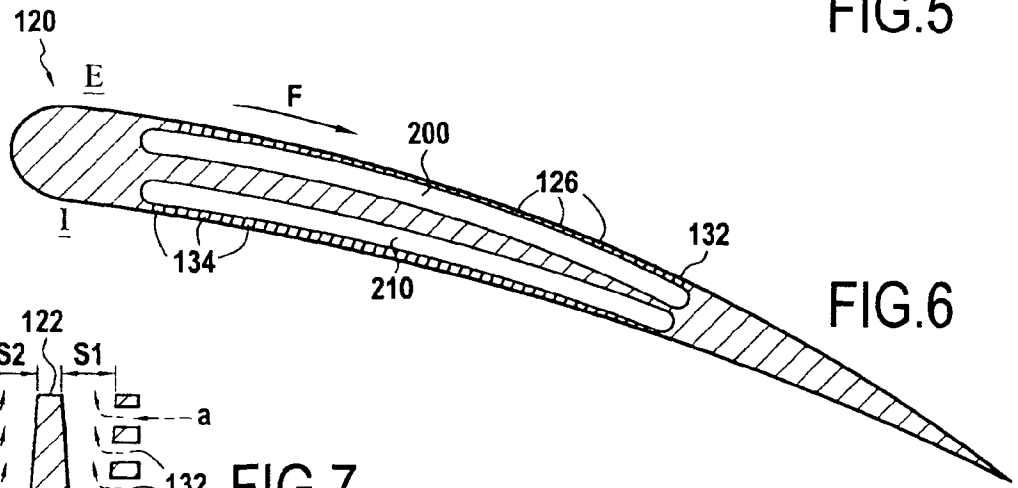
FIG. 6 is a longitudinal section view of the vane shown in FIG. 5 on plane VI-VI.

With reference to FIGS. 5 and 6, there follows a description of the second embodiment of the present invention.

Elements that are identical to those in the first embodiment have the same numerical references plus 100.

The vane 120 shown in FIG. 5 is of the same type as that in the first embodiment.

It includes a first series of slots 126 opening out into the suction side E, and a second series of slots 134 opening out into the pressure side I. In a variant, the slots 126, 134 may be replaced by perforations 132 as shown in FIG. 5. Slots and perforations may also be used in alternation depending on the sought-after effect.

The second embodiment differs from the first in that the slots 126 of the first series are in communication with a single first cavity 200 that is formed in the vane 120, whereas the slots 134 of the second series are in communication with a single second cavity 210 formed in the vane 120.

The first cavity 200 has a transverse extent that is slightly greater than the length of the slots 126 and a longitudinal extent that is not less than the longitudinal extent of the distribution of slots 126.

Similarly, the second cavity 210 has a transverse extent that is slightly greater than the length of the slots 134 and a longitudinal extent that is not less than the longitudinal extent of the distribution of slots 134.

As can be seen in FIG. 6, the first and second cavities 200, 210 extend longitudinally and at the same time they are superposed on each other.

Both of them open out into the first flank 122 of the vane 120 that opposes a second flank 124 of the vane 120.

Figure 7:
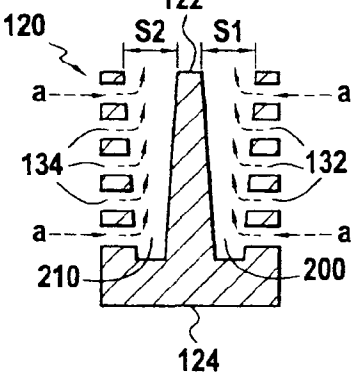
FIG. 7 is a cross-section view of the vane shown in FIG. 5, on plane VII-VII and showing the variation of the cross section of the cavities.

FIG. 7 is a section view taken on a transverse plane VII-VII that shows that the cross section S1, S2 of each cavity 200, 210 varies, increasing towards the first flank 122. It can be seen that the cavities 200, 210 are open towards the first flank 122.

In this example, the variation follows a linear function.

As in the first embodiment, suction is applied via the cavities 200, 210 in such a manner as to draw the flow of fluid F against the surface of the suction side E and the pressure side I through the slots 126, 134 so as to avoid separation of the flow F.

An example of the relationship for variation in cross section is given in FIG. 8. The graph shows the variation of the cross section of a cavity in communication with four orifices 32 or 132 of section that is equal to 1. The x-axis represents the transverse axis of the vane, while the y-axis represents the normalized cross section.

Figure 9:
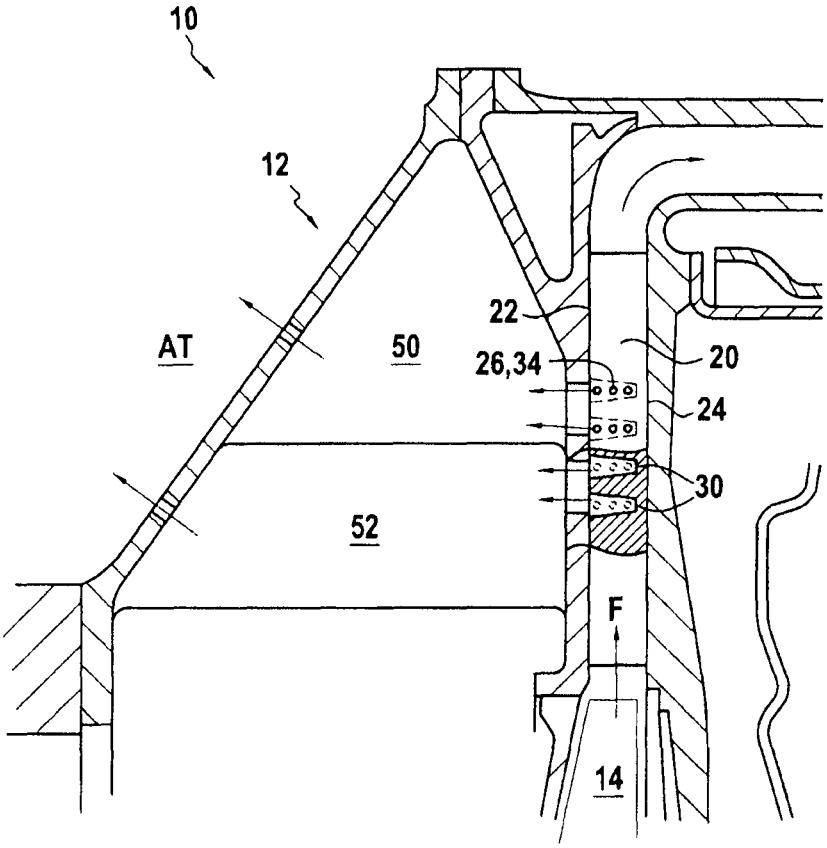
FIG. 9 is a view of a detail of the gas turbine shown in FIG. 1 showing how the fluid sucked in from a vane of the diffuser is discharged.

Finally, FIG. 9 shows the diffuser 18 of the invention mounted inside a casing of the gas turbine 10. Although the figure shows the vane of a first embodiment, the above-mentioned description is entirely transposable to the second embodiment.

The recesses 30 associated with the orifices 26 of the first series are connected to a first chamber 50, while the recesses 36 associated with the orifices 34 of the second series are connected to a second chamber 52 that is separate from the first chamber 50.

The fluid sucked in from the slots 26 flows in the first chamber 50 via the recesses 30 before being discharged into the atmosphere for example, while the fluid sucked in from the slots 34 flows in the second chamber 52 via the recesses 36 before being discharged into the atmosphere AT. Naturally, leak-tightness between the first and second chambers 50, 52 must be ensured. Provision could be made for other methods of discharge while taking care that the fluid sucked in by the slots 26 does not meet with the fluid sucked in by the slots 34.

In a variant, it is also conceivable for the recesses associated with the orifices of the second series to open out into the second flank 24, after which the sucked-in air is discharged by the first flank 22 for air sucked in from the suction side E, and by the second flank 24 for air sucked in from the pressure side I.

The invention claimed is:

1. A diffuser for a mixed flow or centrifugal compressor of a gas turbine, the diffuser comprising:

a vane having a pressure side, a suction side, and a first flank, the vane including a plurality of orifices opening out into at least one of the suction side and the pressure side and communicating with a cavity formed in the vane, the cavity extending in a transverse direction relative to the vane and opening out into the first flank, wherein a cross section of the cavity varies in the transverse direction of the vane, the cross section increasing towards the first flank.

2. The diffuser according to claim 1, wherein the plurality of orifices includes a first series of orifices opening out into the suction side and communicating with the cavity provided in the vane and opening out into the first flank.

3. The diffuser according to claim 2, including a single cavity opening out into the first flank.

4. The diffuser according to claim 2, including a plurality of cavities forming recesses opening out into the first flank.

5. The diffuser according to claim 4, wherein each of the recesses is of frustoconical shape.

6. The diffuser according to claim 1, wherein the plurality of orifices includes a series of orifices opening out into the pressure side and communicating with at least one other cavity provided in the vane and opening out into one of the first flank and a second flank of the vane.

7. The diffuser according to claim 6, wherein a cross section of the at least one other cavity varies, increasing towards a first flank of the vane.

8. The diffuser according to claim 6, wherein the series of orifices communicates with a single cavity opening out into the first flank.

9. The diffuser according to claim 6, wherein the series of orifices communicates with a plurality of cavities forming recesses opening out into the first flank.

10. The diffuser according to claim 9, wherein each of the recesses is of frustoconical shape.

11. The diffuser according to claim 1, wherein the plurality of orifices are at least one of transverse holes and slots.

12. A turboengine including a diffuser according to claim 1.

13. A diffuser for a mixed flow or centrifugal compressor of a gas turbine, the diffuser comprising:

a vane having a pressure side, a suction side, and a first flank, the vane including a plurality of orifices opening out into at least one of the suction side and the pressure side and communicating with a cavity formed in the vane, the cavity extending in a transverse direction relative to the vane and opening out into the first flank, wherein a cross section of the cavity varies in the transverse direction of the vane, the cross section increasing towards the first flank, wherein the plurality of orifices includes a first series of orifices opening out into the suction side and communicating with the cavity provided in the vane and opening out into the first flank, and wherein the plurality of orifices further includes a second series of orifices opening out into the pressure side and communicating with at least one other cavity provided in the vane and opening out into one of the first flank and a second flank of the vane.

14. The diffuser according to claim 13, wherein a cross section of the at least one other cavity varies, increasing towards a first edge of the vane, and wherein the second series of orifices communicates with a single cavity opening out into the first flank.

* * * * *